US005458263A

United States Patent [19]

Ciammitti et al.

[11] Patent Number: 5,458,263

[45] Date of Patent: Oct. 17, 1995

[54] DISPENSER FOR AEROSOL DEVICE

[75] Inventors: Sam Ciammitti, Phoenix; Jody L Numbers, Tempe, both of Ariz.

[73] Assignee: Guardian Royalty Corporation, Sharon, Pa.

[21] Appl. No.: 319,609

[22] Filed: Oct. 7, 1994

Related U.S. Application Data

[63] Continuation of Ser. No. 54,148, Apr. 30, 1993, Pat. No. 5,366,118.

[51] Int. Cl.[6] ..... B65D 83/14

[52] U.S. Cl. ..... 222/153.1; 222/183; 222/402.11; 222/153.13; 222/153.14

[58] Field of Search ..... 222/402.11, 183, 222/153

[56] References Cited

U.S. PATENT DOCUMENTS

| | | | |
|---|---|---|---|
| 3,445,046 | 5/1969 | Wilson | 239/337 |
| 3,450,313 | 6/1969 | Jonas | 222/402.13 |
| 3,474,939 | 10/1969 | O'Donnell et al. | 222/402.11 |
| 3,863,814 | 2/1975 | Shelton | 222/153 |
| 4,024,988 | 5/1977 | Starrett | 222/402.11 |
| 4,220,263 | 9/1980 | Caruso | 222/183 |
| 4,301,947 | 11/1981 | Potter | 222/182 |
| 4,324,351 | 4/1982 | Meshberg | 222/402.11 |
| 4,434,914 | 3/1984 | Meshberg | 222/402.11 |
| 4,449,474 | 5/1984 | Mariol | 222/182 |
| 4,454,966 | 6/1984 | Hicks | 222/402.11 |
| 4,776,491 | 10/1988 | Nitta | 222/402.11 |
| 5,070,611 | 12/1991 | Dean et al. | 222/402.11 |
| 5,111,968 | 5/1992 | Wilkerson | 222/175 |

*Primary Examiner*—Karen B. Merritt
*Attorney, Agent, or Firm*—Vickers, Daniels & Young

[57] ABSTRACT

A holder for an aerosol canister. The holder has a housing and a cap. The cap receives the valve stem of the canister and when depressed will discharge the contents of the canister at a discharge nozzle in the cap. An annular locking ring has a projection which in one position prevents the cup from being pressed downwardly relative to the housing.

19 Claims, 2 Drawing Sheets

FIG. 1
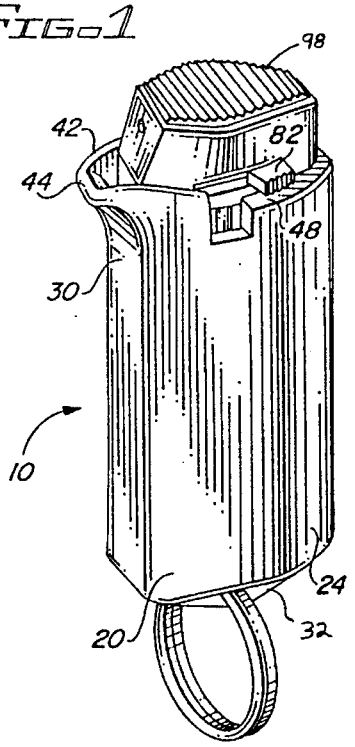
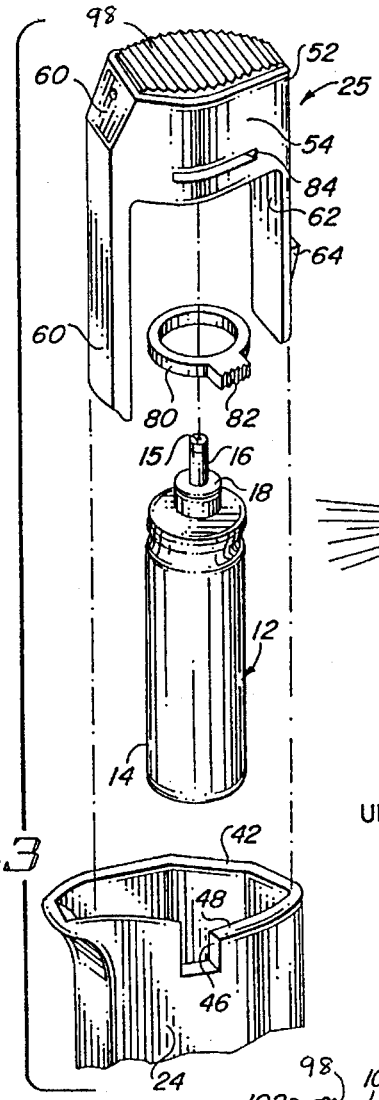
FIG. 3
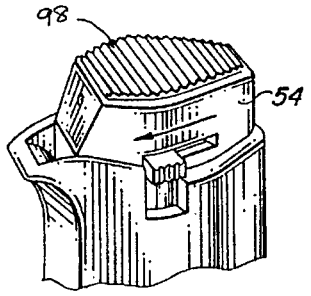
FIG. 2A
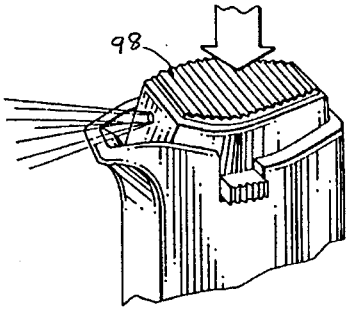
FIG. 2B
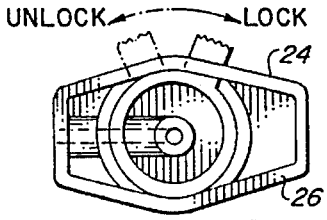
FIG. 6
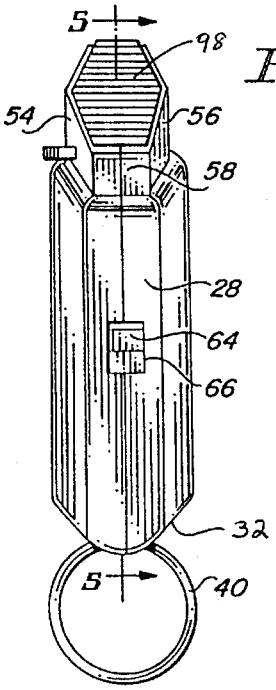
FIG. 4
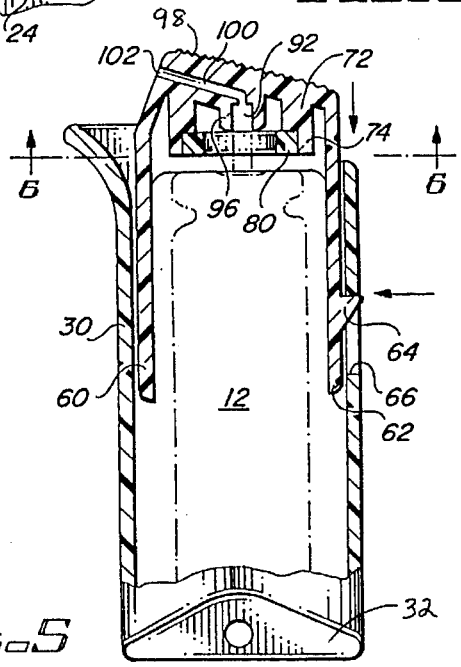
FIG. 5

DISPENSER FOR AEROSOL DEVICE

This is a continuation of application Ser. No. 08/054,148, filed Apr. 30, 1993, now U.S. Pat. No. 5,366,118.

The present invention relates to a dispenser and more particularly relates to a dispenser or holder for aerosol containers which dispenser has a locking feature to prevent the unintentional or inadvertent release of the contents of the aerosol container.

Many consumer products are provided or are packaged in aerosol containers, the contents of which are dispersed or dispensed by depressing an actuating valve on the container. Typical examples of such products which are packaged in this manner are perfumes, colognes, breath fresheners, hair sprays, insect repellents and the like. Another type of product provided in an aerosol container is a personal security device containing a self-defense spray which can be easily carried by the user in a pocket or handbag. The device is grasped and when actuated will discharge an aerosol chemical spray to deter an attacker or assailant. Various types of deterrent chemicals are commercially available in aerosol form as personal defense products and one of the more popular is a capsicum or pepper composition of the type sold under the trademark "BODYGUARD" by Guardian Products of Phoenix, Ariz.

Several problems may occur attendant to the use of aerosol containers and particularly those such as personal defense products. Aerosol products of this type must be convenient to use so that the consumer can carry the dispenser in a pocket or purse in a manner so that the aerosol deuce can be quickly and easily retrieved and actuated. It is also desirable to protect the aerosol canister so that it is not unintentionally or inadvertently actuated. The device should also be designed so that when retrieved, it can be quickly oriented with the discharge nozzle properly aimed which orientation should be able to be accomplished tactilely or by feel without the user having to visually check the proper position of the aerosol device.

Various containers or holders for aerosol devices can be found in the prior art. U.S. Pat. No. 5,111,968 discloses a hand-held tear gas canister and personal security device having an elongate ridge or rib on the outer surface of the canister or on a holster to facilitate orientation of the canister.

U.S. Pat. No. 4,454,966 shows a case for enclosing an aerosol dispenser. The case conforms to the form of the aerosol and is designed particularly to conform to the actuator of the aerosol dispenser to permit operation of the dispenser while the dispenser is contained within the case.

U.S. Pat. No. 4,449,474 discloses a personal security device which comprises a trigger-actuated aerosol canister contained in a two-piece telescoping housing.

U.S. Pat. No. 3,863,814 ddiscloses a safety cap for aerosol cans incorporating a central split cylinder having hooked ends. The hooked ends are locked beneath the can bead by a ring which may be slid downwardly on the sections to lock the device. Release of the hooked ends is affected by upwardly sliding the ring and depressing the cap to outwardly flex the hooked ends. Upon retraction of the hooked ends, the cap can be lifted from the can. The device is intended primarily as a safety cap for aerosol cans.

U.S. Pat. No. 3,450,313 discloses a spring metal holding clip for aerosol containers having an end that is made to snugly fit in the annular recessed top of the container to resist upward displacement. The plastic cap fits around the top portion of the container having a slot through which the spring clip extends. With the clip in this position, the user by feel can properly direct the spray nozzle.

U.S. Pat. No. 3,445,046 shows a holster for holding an aerosol container which holster has an opening for discharge of fluid from the container. An access opening to a valve actuator on the container is provided along with means to hold or clip the holster on the belt while also allowing quick detachment.

U.S. Pat. No. 4,301,947 shows a device which is to be added to a tear gas canister which fits over the canister and provides a guiding tunnel over the discharge button so that by feel alone, the device may be properly grasped and actuated by depressing the button with the user's finger.

While, as indicated above, there are a number of various type of holsters, containers and the like for various types of aerosol devices, particularly those of the personal defense type, there nevertheless exists a need for an improved dispenser or holder which is convenient to use, assists in properly orienting the discharge spray and which also provides a locking feature to minimize the possibility of inadvertent or accidental discharge of the aerosol spray.

Briefly, the present invention provides a holder or dispenser having a housing which has an interior compartment which replaceably houses the aerosol canister. The housing is configured having an exterior gripping surface that can be comfortably grasped in the hand of the user and which is provided with a projecting lip against which the first finger rests to allow the user to tactilely orient the device. A cap extends across the open tapper end of the housing and defines a seat which engages the upper end of the aerosol canister. The cap is provided with an internal passageway which communicates with the valve stem of the canister, which passageway terminates at a discharge nozzle. The contained aerosol canister is actuated by depressing the cap downwardly with a thumb or finger which presses the valve stem downwardly. A detent retains the cap in position relative to the housing but allows the components to be disassembled for removal and replacement of the aerosol canister. An annular locking ring is provided in the cap and has an outwardly extending projection. In one position, the locked projection engages a surface of the lower housing preventing downward displacement of the cap and actuation of the contained aerosol canister.

It is therefore a primary object of the present invention to provide an improved dispenser for aerosol containers.

It is another object of the present invention to provide an improved aerosol dispenser which dispenser facilitates quick and efficient orientation and actuation of the aerosol container.

It is another object of the present invention to provide an aerosol dispenser which replaceably contains a conventional aerosol canister and which dispenser is provided with a locking mechanism to prevent the inadvertent or unintentional actuation of the contained aerosol canister.

It is a specific object of the present invention to provide a dispenser particularly adapted for containment of aerosol personal defense canisters.

The above and other objects and advantages of the present invention will become more apparent from the following description, claims and drawings in which:

FIG. 1 is a perspective view showing the dispenser of the present invention;

FIG. 2A is a partial perspective view of the dispenser showing the dispenser in an unlocked position;

FIG. 2B is a view similar to FIG. 2A showing the dispenser with the cap depressed in an actuated position;

FIG. 3 is a partial exploded view showing the components of the dispenser and the contained aerosol canister;

FIG. 4 is a rear view of the dispenser of the present invention;

FIG. 5 is a sectional view taken along line 5—5 of FIG. 4;

FIG. 6 is a sectional view taken along line 6—6 of FIG. 5 showing the device in both a locked and unlocked position:

Figure 7C:
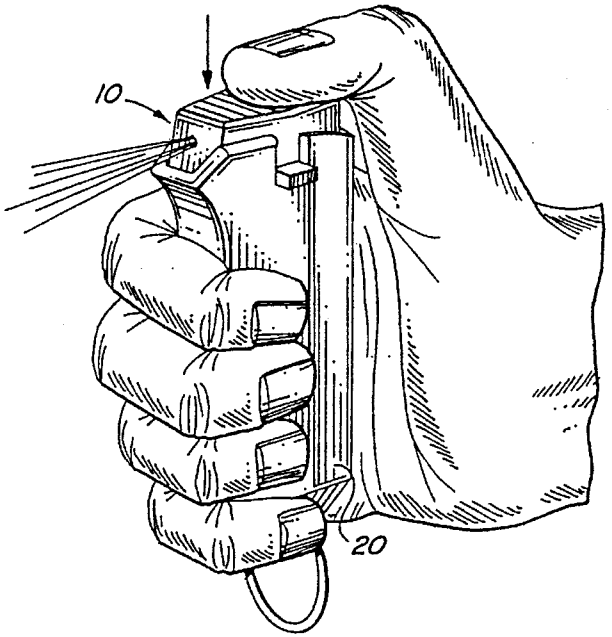
FIG. 7C is a view similar to FIG. 7A showing the cap depressed and the aerosol actuated for release.

Turning now to the drawings, the dispenser device of the present invention is generally designated by the numeral 10 and is adapted for use with an aerosol container of the type designated by numeral 12. As indicated, the aerosol container 12 may be used to contain and dispense various types of products including personal defense sprays. Typically the aerosol has a cylindrical canister 14 which contains a pressurized fluid which is released at nozzle 15 when the stem or plunger 16 is depressed causing the valve 18 to open. The pressurized contents of the canister are released as long as the stem 16 is maintained in its downwardly depressed position. The general construction of aerosol canister as described above is conventional and well known to those in the art. The container per se forms no part of the invention.

The dispenser 10 of the present invention is adapted to contain aerosol containers of various types as have been described and as such provides a convenient exterior gripping and orientation surface. The dispenser also provides the user a locking mechanism to minimize the possibility of inadvertent or unintentional actuation of the aerosol and release of the contents. Unintentional actuation of the aerosol in the case of a defense spray may be annoying or even harmful to the user and those in the immediate area. Further, the dispenser of the present invention is configured so that it can be oriented tactilely so that when properly grasped, the discharge nozzle is oriented slightly upwardly and away from the user when held in a normal use-position. In one convenient motion the user can grasp the dispenser and contained aerosol canister from the pocket or purse and tactilely from the configuration of the handle direct the nozzle correctly for protection against attack by a person or animal.

Referring again to the drawings, the dispenser 10 has an elongate housing 20 having opposite side walls 24 and 26, rear wall 28 and front wall 30. Bottom wall 32 extends across the lower end of the housing. The walls 24 and 26 are shown as being slightly outwardly convex and along with the rear and front walls define a grip which may be conveniently grasped by the fingers of the user with the thumb extending around one side. For example, as seen in FIG. 7A and 7B, when grasped by the right hand of the user, the first two or three fingers normally curl around side wall 26 and the thumb of the user rests against side wall 24. An aperture 36 is shown extending transversely through the bottom wall to provide a convenient means of attaching a key ring 40.

The upper open end of the housing is defined by a peripheral edge 42. Edge 42 flares or projects forwardly at the tipper end of wall 30 at 44 defining a lip beneath which the first finger of the user normally rests when the device is grasped. A recess 46 intercepts edge 42 and extends downwardly in side 24. A land 48 is defined along a portion of edge 42 immediately adjacent recess 46 which serves as a stop for the locking ring as will be explained.

The housing 20 defines an interior chamber 50 which replaceably receives the aerosol container 12 as best shown in FIGS. 5 and 6. The interior of opposite walls 24 and 26 are spaced apart to allow easy insertion and removal of the aerosol container. The interior surfaces of walls 24 and 26 are slightly convex to snugly retain the container in the central position in chamber 50 and still allow the container to be removed and replaced.

The cap assembly 25 includes a cap portion 52 which has opposite side walls 54 and 56, rear wall 58 and front wall 60. The cap assembly 25 has a pair of oppositely and downwardly extending legs 60 and 62 which are slidably engageable along the interior sides of front and rear walls 30 and 28, respectively, of the housing 20.

The cap assembly is retained in place by a detent 64 which in the assembled position is received within slot 66 which extends axially in housing wall 28 as best seen in FIG. 5. Preferably the cap and housing are fabricated from a suitable material such as molded plastic and the depending legs 60 and 62 have stone flexibility so that assembly of the cap assembly and housing is easily accomplished as legs 60 and 62 will flex inwardly as the cap assembly is inserted into the housing allowing detent 64 to become engaged in slot 66. In this position, as seen in FIG. 5, the cap assembly may be pushed downward guided by the position of the detent 64 within slot 66.

The interior of the cap assembly has a downwardly projecting boss 72 which defines a seat 74 which secures locking ring member 80. Ring member 80 is annular having radial projection 82 which extends through slot 84 in the side wall 54 of the cap assembly. Slot 84 permits the locking ring to be rotated from the locked position to the unlocked position shown in FIG. 6.

The cap assembly also defines an axially extending bore 92 which is circular in cross section and is adapted to align with and receive the end of the valve stem 16 of the canister. As seen, bore 92 is defined by an annular boss 96 having a lower end which in the normal assembled position is concentric positioned within the annular locking ring 80. In the assembled position, the upper end of the stem 16 abuts or is closely adjacent the bottom of the bore 92 so that downward movement of the cap assembly 25 will depress the stem to actuate valve 18 releasing the contents of the canister.

The upper surface 98 of the cap forwardly inclines and has a plurality of transversely extending ridges to enhance operation by making the surface easily identifiable by feel. To actuate the device, the user presses downwardly on this surface. The downward actuation of the cap will, in turn, push the valve stem downwardly opening the valve of the canister. The contained aerosol fluid is discharged through the stem of the valve and is delivered via passage 100 in the cap assembly to discharge nozzle 102. It will be noted that the passage 100 is also inclined forwardly and upwardly so that in the normal position, the direction of the spray will be slightly upward and away from the user which in the case of a human assailant will normally direct the spray toward the person's face. The discharge nozzle is located above lip 44.

In use, the user may easily disassemble the device by pressing the detent 64 inward slightly to deflect leg 62 permitting the cap assembly to be withdrawn from the housing. A suitable aerosol container 12 may be placed in the interior chamber 50 of the housing with the bottom of the canister of the container resting against inner side of bottom wall 32. In this position, the central valve stem 16 will project axially upward. The cap assembly may then be re-positioned with respect to the housing by aligning legs 60 and 62 against the interior surfaces of walls 30 and 28. Downward force will bring the detent 64 into engagement with its associated slot 66.

In the normal stored position as in a handbag or pocket, the locking ring 80 will be in the position shown in FIG. 1 with the projection 82 engaging the land surface 48 located on the upper edge 42 of the housing. The engagement of the projection against the land 48 will resist downward, actuating force on the cap assembly.

When the user intends to discharge the aerosol canister contents, the user grasps the housing as seen in FIG. 7A. The grip-like configuration of the body will serve to properly orient the device in the user's hand. In the normal position, the fingers will be curled around the housing 20 with the second joint of the first finger nestled below the projecting lip 44. The user's thumb will rest against the surface 24 and in this position, projection 82 may be easily pushed forward to bring the projection into alignment with the recess 46 which places the cap assembly in an unlocked position, as seen in FIG. 7B.

Figure 7B:
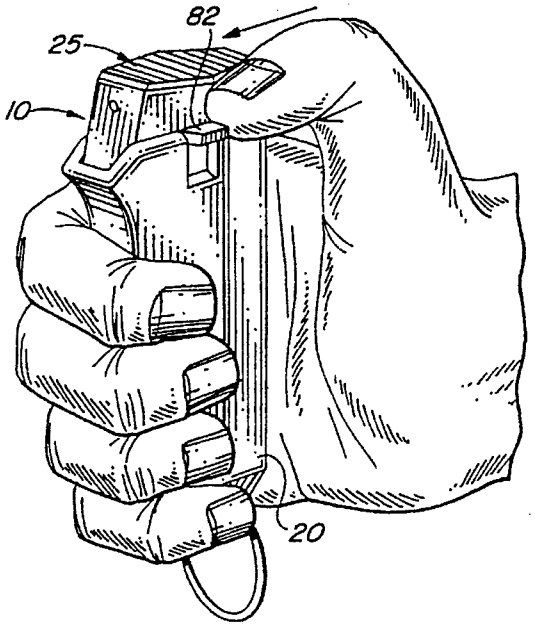
FIG. 7B is a view similar to FIG. 7A with the device in an unlocked position.
Figure 7A:
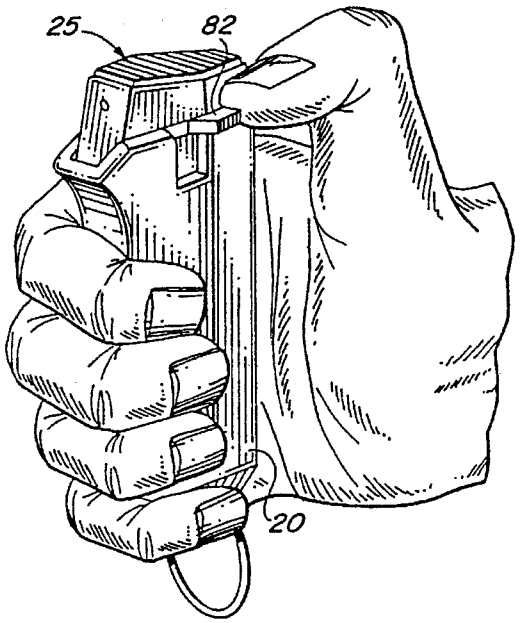
FIG. 7A is a perspective view showing the device hand held in position to unlock the cap.

The user may then move the user's thumb to the upper surface of the cap assembly and downward force may be applied to the upper surface of the cap assembly as shown in FIG. 7C. The alignment of the projection 82 with the recess 46 allow the cap assembly to move downward bringing the inner end of the bore 92 into engagement with the upper end of the valve stem. Further depression of the cap will cause the actuating valve 18 to release the contents of the aerosol into passage 100 leading to discharge nozzle 102. In the normal use-position, in which the user will hold the device with the arm extended, will orient the spray away from and slightly upwardly to ward-off an attacking human or animal.

When the device is not in use, the locking projection 82 may be returned to the locked position shown in FIG. 1 in which position, inadvertent or unintentional actuation of the device is resisted.

The device of the present invention may be inexpensively manufactured from various materials and preferably the device is injection molded from a suitable plastic such as PVC, styrene or ABS. The device may be provided in a variety of colors and may be further provided with a convenient key ring 40 as shown in FIG. 1 of the drawings. The dispenser may be conveniently retained in a purse or a user's pocket as it is small and relatively unobtrusive but provides substantial convenience and advantages as compared with the non-contained aerosol dispensers.

It will be understood from the foregoing that the dispenser of the present invention provides an improved dispenser for aerosol devices of all types including personal defense devices which utilize a defense spray such as capsicum. The device provides a lock to resist the inadvertent or accidental discharge of the contents of the aerosol and also provides the user immediately upon grasping the canister, the ability to ascertain the correct orientation of the device for proper discharge of the spray. The latter advantage is significant in case of sudden danger as the dispenser facilitates quick proper positioning of the device even in dark areas.

It will be apparent to those skilled in the art to make various changes, alterations and modifications to the embodiment of the invention described herein. To the extent those various changes, alterations and modifications do not depart from the spirit and scope of the appended claims, they are intended to be encompassed therein.

We claim:

1. A dispenser for dispensing a pressurized fluid comprising:

a canister of pressurized fluid having a discharge nozzle, a cylindrical side wall and a bottom wall;

actuator means releasably connected to said nozzle; and housing means having a bottom wall and sidewalls integral therewith defining an interior compartment for substantially enclosing said canister, said housing means being in sliding contact with said actuator means.

2. A dispenser according to claim 1, including locking means for locking said actuator means relative to said housing means.

3. A dispenser according to claim 2, wherein said locking means comprises a tab movable between a first position for allowing said actuator means to move relative to said housing means and a second position for preventing said actuator means from moving relative to said housing means, said tab being movable independently of said actuator means and said housing means.

4. A dispenser according to claim 2, wherein said housing means includes at least one of said sidewalls having a slot therein and said locking means comprises a locking ring having a tab extending therefrom, said ring being rotatable between a first position wherein said tab is aligned with said slot and a second position wherein said tab is offset from said slot, said locking ring being movable independently of said actuator means and said housing means.

5. A dispenser according to claim 1, further including means for releasably connecting said actuator means to said housing means.

6. A dispenser to claim 5, wherein said housing means comprises a casing, said actuator means comprises a body portion having at least one leg depending therefrom for slidably engaging said casing, and said interior compartment having a top opening for receiving said canister and said at least one leg.

7. A dispenser according to claim 1, wherein said bottom wall of said canister rests on said bottom wall of said housing means.

8. A dispenser for dispensing a pressurized fluid comprising:

a canister of pressurized fluid having a discharge nozzle and including a cylindrical side wall;

actuator means releasably connected to said nozzle and including at least one leg disposed adjacent to said side wall; and, housing means for receiving said canister, said housing means being in sliding contact with said actuator means.

9. A dispenser for dispensing a pressurized fluid comprising:

a canister of pressurized fluid having a discharge nozzle and including a cylindrical side wall;

housing means for receiving said canister;

actuator means releasably connected to said nozzle and including at least one leg disposed adjacent to said side wall, wherein said at least one leg is received within said housing means for sliding engagement therewith; and said housing means being in sliding contact with said actuator means.

10. A personal protection device comprising:

a canister containing a fluid under pressure, said canister including a nozzle through which said fluid can be discharged;

a first housing element connected to said nozzle; and a second housing element including an interior compartment for substantially containing said canister and being releasably connected to said first housing element for reciprocating movement therewith;

whereby moving first housing element relative to said second housing element causes said fluid to be dispensed.

11. A device according to claim 10, wherein said first housing element includes leg portions adapted to be received by said second housing element.

12. A device according to claim 11, wherein at least one of said leg portions includes limiting means for limiting reciprocating movement between said at least one leg and said second housing element.

13. A device according to claim 10, further including locking means for preventing relative movement between said first housing element and said second housing element.

14. A personal protection device according to claim 10, wherein said canister includes a cylindrical side wall and a bottom wall and said second housing element includes a bottom wall for supportably engaging said bottom wall of said canister.

15. A dispenser for an aerosol container of the type having a canister with a valve-actuated discharge mechanism, said dispenser comprising:

a housing defining an interior compartment having an open end adapted to receive said canister, said housing having an exterior surface adapted to be grasped by the user; and a cap positioned at said open end of said housing and slidably connected thereto, moveable between first and second positions relative to said housing, said cap defining an area receiving at least a part of said discharge mechanism and defining a passageway communicating with said discharge mechanism and terminating at a nozzle whereby movement of said cap to said second position will cause the contents of said canister to be released to said passageway.

16. The dispenser of claim 15, further including locking means associated with said cap, said locking means moveable between first and second positions, said first position preventing relative movement between said housing and cap and said second position permitting relative movement between said housing and cap.

17. The dispenser of claim 16, wherein the outer surfaces of said housing are formed as a grip having opposite sides which are generally convex.

18. A dispenser for dispensing a fluid comprising a pressurized canister of fluid having a top wall and a valve stem extending through said top wall, said valve stem being moveable between a high position and a low position relative to said top wall wherein fluid is dispensed through said stem in said low position, the improvement comprising:

a cap having a nozzle, said cap connected to said valve stem and defining an interior passageway terminating at said nozzle for directing said fluid from said stem to said nozzle; and housing means slidably engaging said cap and containing said canister;

whereby sliding said cap and said housing means toward one another moves said valve stem into said low position.

19. A dispenser for dispensing a pressurized fluid comprising:

a canister of pressurized fluid having a bottom end and a top end having a discharge nozzle;

actuator means connected to said nozzle; and housing means having a closed bottom and an open top for receiving said bottom end of said canister, said housing means slidably engaging said actuator means.

* * * * *